United States Patent [19]

Brown

[11] Patent Number: 4,784,432

[45] Date of Patent: Nov. 15, 1988

[54] ADJUSTABLE CHAIR

[75] Inventor: Jerrold G. Brown, Wooster, Ohio

[73] Assignee: Rubbermaid Incorporated, Wooster, Ohio

[21] Appl. No.: 83,699

[22] Filed: Aug. 7, 1987

[51] Int. Cl.[4] ..... A47C 4/00

[52] U.S. Cl. ..... 297/28; 297/359; 297/356

[58] Field of Search ..... 297/28, 27, 29, 359, 297/360, 356

[56] References Cited

U.S. PATENT DOCUMENTS

| | | | |
|---|---|---|---|
| 392,009 | 10/1888 | Cleaveland | 297/356 X |
| 668,324 | 2/1901 | Bray et al. | 297/356 |
| 770,395 | 9/1904 | Seng | 297/356 |
| 793,274 | 6/1905 | Breithut | 297/356 X |
| 2,659,416 | 11/1953 | Heyman | 297/28 |
| 2,776,704 | 1/1957 | Moore et al. | 297/27 |
| 2,812,013 | 11/1957 | Kreciglowa | 297/359 |
| 2,847,060 | 8/1958 | Pearlstine . | |
| 2,981,316 | 4/1961 | Goebel . | |
| 3,075,811 | 1/1963 | Brown | 297/359 |
| 3,186,757 | 6/1965 | Hopkins | 297/359 X |
| 4,421,358 | 12/1983 | Lehren | 297/28 X |
| 4,674,793 | 6/1987 | Kettler | 297/28 |

FOREIGN PATENT DOCUMENTS

| | | | |
|---|---|---|---|
| 733801 | 5/1966 | Canada | 155/50 |
| 87177 | 4/1959 | Denmark . | |
| 326491 | 5/1935 | Italy | 297/28 |
| 860760 | 2/1961 | United Kingdom . | |

*Primary Examiner*—Francis K. Zugel

*Attorney, Agent, or Firm*—Renner, Kenner, Greive, Bobak, Taylor & Weber

[57] ABSTRACT

An article of furniture such as a chair (10) includes a seat member (13), a back member (11) pivotally attached to the seat member (13), leg members (14,16) attached to the seat member (13), and arm members (20) attached to the back member (11). The arm members (20) are associated with the leg members (14,16) such that the angular relationship between the seat member (13) and the back member (11) may be adjusted to a plurality of positions. A track system (26) defines a plurality of adjacent stop positions (29) with a pin member (46) interacting with the track system(26) to engage a stop position (29) therealong. The track system (26) is configured so that upon relative movement of the track system (26) and the pin member (46), the pin member (46) engages the next adjacent stop position (29) thereby moving the back member (11) with respect to the seat member (13) only to the next adjacent plurality of relative angular positions.

25 Claims, 5 Drawing Sheets

ADJUSTABLE CHAIR

TECHNICAL FIELD

This invention relates to an article of furniture, such as a chair, of the type in which the angular relationship of the seat and the back is adjustable. More particularly, this invention relates to the construction of the armrests and their cooperation with the leg members to effect multiple position adjustment of the chair.

BACKGROUND ART

There are already known various constructions of chairs in which the seat portions are angularly adjustable with respect to the backrest portions. These constructions typically have a seat arranged between lateral portions of a frame. A backrest is pivotally attached to the seat. An armrest is fixedly attached to the backrest and the frame. The backrest is adjustable from an erect position to one which is reclined. This adjustment is generally controlled by movement of the armrest in conjunction with the application of force to the backrest by the user of the chair. While these constructions satisfy the objective of providing seating and/or lounging in a plurality of body positions, they typically suffer from a variety of undesirable characteristics.

One such characteristic is that the locking and releasing mechanisms most often carried in the armrest to effect adjustment of the backrest are "crashable". That is, once the armrest is lifted so as to become disengaged from its locked position, and force is applied to the backrest and/or the arms by the user, the backrest tends to "crash" to its fully reclined position. Such action will undoubtedly alarm the user, especially a user unfamiliar with the chair. Additionally, the user can be injured due to this rapid, unexpected movement and sudden, abrupt stop. Moreover, if the user is holding a beverage when attempting to adjust the chair, as is often the case when such chairs are used at a beach, the crash of the backrest often causes the user's beverage to spill or splash upon the user.

One example of this typical type of adjustable chair is disclosed in Danish Pat. No. 87177. The ratchet track system employed therein and carried in the armrest to effect adjustment of the chair, requires that the user lift up and pull forward on the arm so as to disengage the locking mechanism and permit the backrest to be reclined. Once disengaged, however, the backrest of the chair can easily move rapidly to its fully reclined position, thus startling, and perhaps injuring the user. Two other adjustable chair constructions exhibiting such crash potential are shown in U.S. Pat. No. 2,981,316 and British Pat. No. 860,760.

A typical chaise longue construction is disclosed in U.S. Pat. No. 2,847,060 and it too possesses this undesirable characteristic. Once the adjustable arm is raised and the locking pin disengages the holding notch, the locking pin is allowed to move freely within an elongate channel causing the user to blindly seek another holding notch with a crash of the backrest being likely. Disclosed in this patent is one attempt to ameliorate the unpleasantry of such a crash, such being in the form of a tension spring which resists the recline of the backrest. A crash, however, is still likely for the spring cannot prevent the crash but only slightly reduce the speed of the recline.

Another undesirable characteristic of typical adjustable chairs is that the adjusting mechanisms often permit a user's fingers to be pinched or cut during adjustment. That is, the adjusting mechanisms are either fully exposed, or are positioned such that the act of adjusting the chair leaves the users hands in a position to be caught between the arm and the frame of the chair. When this undesirable characteristic is combined within a crash-type arm, the potential for injury is even greater due to the speed at which the crash occurs. The undesirable characteristic of an adjustable chair which permits pinching of the user's fingers has been heretofore recognized in both U.S. Pat. No. 3,075,811 and Canadian Pat. No. 733,801. A fully pinch-proof adjustable chair is, however, still unknown.

Many adjustable chairs are designed so as to be foldable and can be folded and stored when not in use. In these foldable chairs, the adjusting mechanism often hinders folding. That is, the adjusting mechanism remains in a locked position, rather than releasing, and thus the chair cannot be folded with ease, or, even worse, the chair cannot be folded at all.

DISCLOSURE OF THE INVENTION

It is therefore a primary object of the present invention to provide an article of furniture wherein the backrest thereof can be angularly adjusted relative to the seat thereof.

It is another object of the present invention to provide an article of furniture, as above, in which the backrest is prevented from crashing to its reclined position during adjustment.

It is a further object of the present invention to provide an article of furniture, as above, in which adjustment thereof can be made without causing injury to the user's fingers.

It is yet another object of the present invention to provide an article of furniture, as above, which is simple in construction and operation.

It is a still further object of the present invention to provide an article of furniture, as above, which can easily be folded when not in use.

These and other objects of the present invention, which will become apparent from the description to follow, are accomplished by the means hereinafter described and claimed.

In general, an article of furniture, such as a chair, includes a seat member, a back member pivotally attached to the seat member, leg members attached to the seat member, and arm members attached to the back member. Means are provided to position the back member at a plurality of angular positions with respect to the seat member, which means include a track member defining a plurality of adjacent stop positions at which the seat member and the back member are at a like plurality of angular positions relative to each other. A pin member interacts with the track member so as to engage a stop position of the track member. The track member is configured such that upon relative movement of the track member and the pin member, the next of the adjacent stop positions is engaged by the pin member so that the back member and the seat member are thereby prevented from moving to other than the next adjacent relative angular position.

PREFERRED EMBODIMENT FOR CARRYING OUT THE INVENTION

Figure 1:
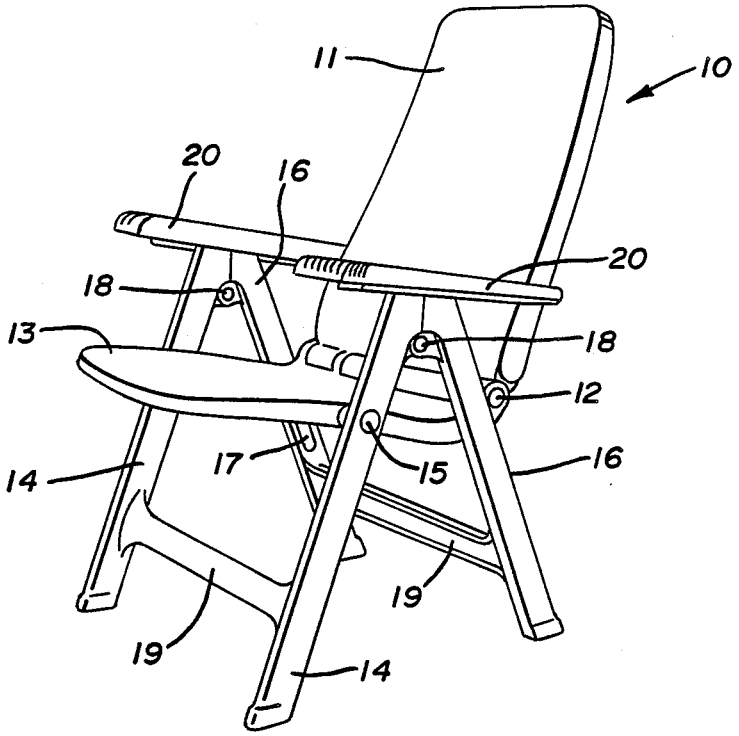
FIG. 1 is a perspective view of a typical chair including the features of the present invention.

A chair including the features of the present invention is indicated generally by the numeral 10 in FIG. 1 and can be made of any suitable material such as plastic so that it is lightweight and feasibly usable both in outdoor and indoor environments. Chair 10 includes a back member 11 pivotally attached in a conventional manner, as at 12, to a seat member 13. Front leg members 14 are pivotally attached to seat member 13, as at 15, with rear leg members 16 being slidably attached to seat member 13 along track 17 in each rear leg member 16. Front leg members 14 and rear leg members 16 are hinged, as at 18, so that, in cooperation with the other pivotal and sliding connections, chair 10 can be folded in a manner to be hereinafter described. Both sets of front and rear leg members 14, 16 can be provided with conventional cross-supports 19.

Chair 10 also includes arm members 20 pivotally attached at their rear ends to back member 11 and medially interacting with selected of the leg members 14, 16 to pivot back member 11 with respect to seat member 13 so as to adjust the relative angular orientation of back member 11 and seat member 13 in a manner now to be described.

Figure 3:
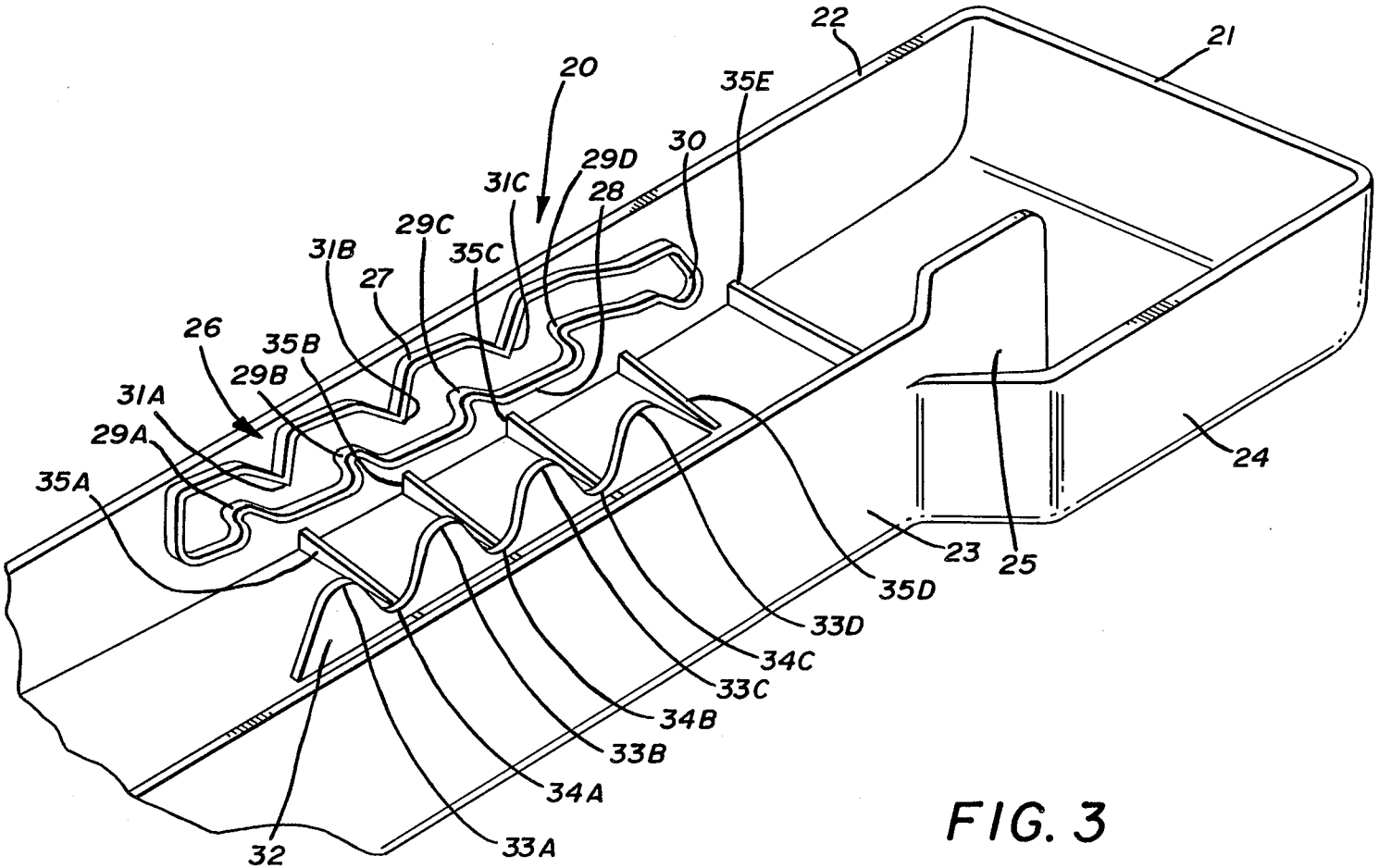
FIG. 3 is a perspective view of the underside of one of the arm members of the chair of FIG. 1 according to the present invention.

One or preferbly both of arm members 20 are provided with an underside configuration best shown in FIG. 3, the left arm member 20 of chair 10 being depicted therein. As shown, each arm member 20 is generally hollow on its underside having an end wall 21 at its outer end and a longitudinally extending inner sidewall 22 on the side adjacent back member 11 and seat member 13. Opposite sidewall 22 is longitudinally extending outer sidewall 23 which flares outwardly to form a grip wall 24 which meets end wall 21. A finger safety tab 25, preferably of a width (or depth) somewhat greater than any of walls 21, 22, 23 and 24, is provided proximate the flaring connection of walls 23 and 24. As will hereinafter be described in more detail, in operation, the user of chair 10 can grasp grip wall 24 with his fingers being positioned between wall 24 and safety tab 25 so that they are not exposed to the adjusting mechanism now to be described.

Figure 4:
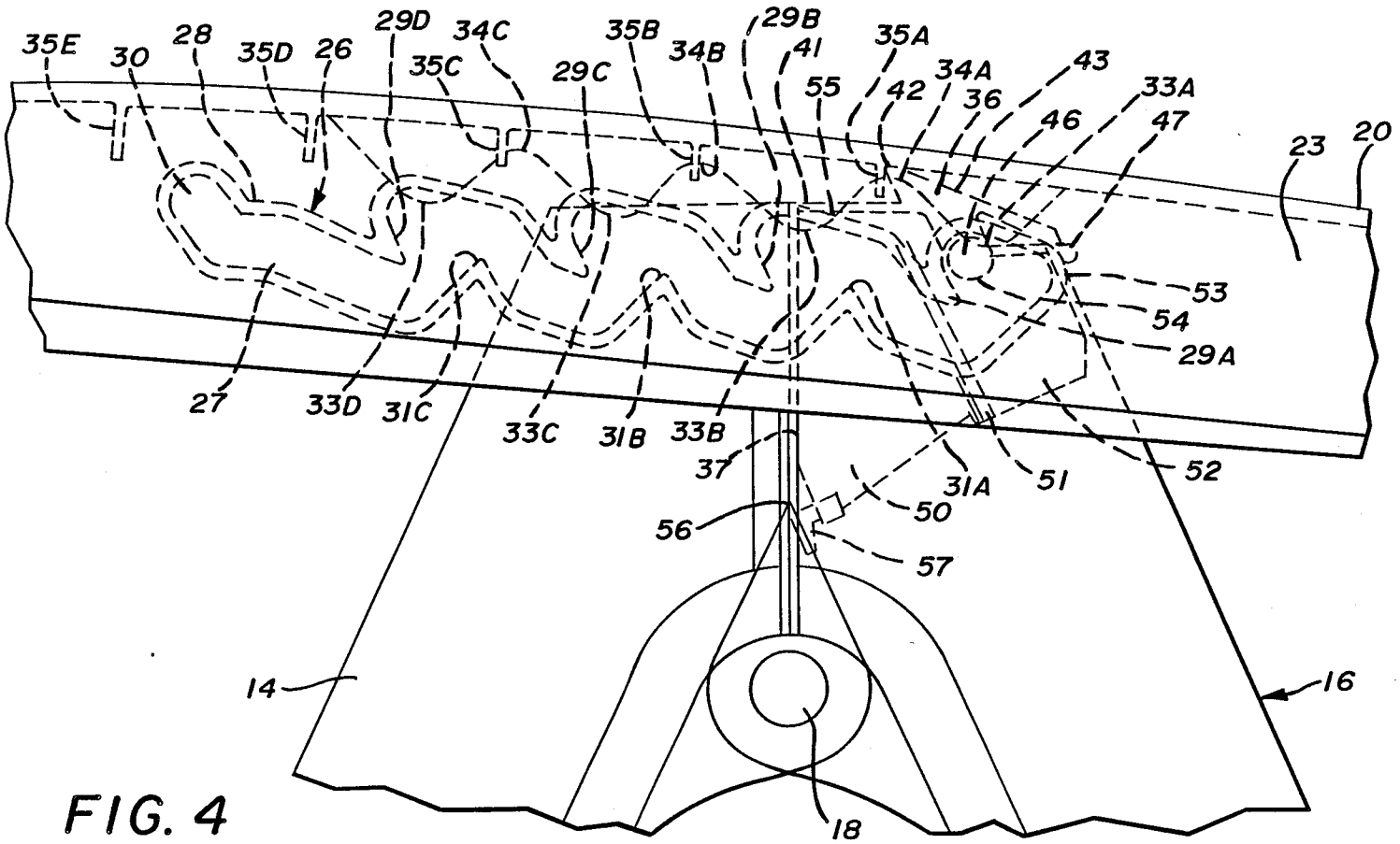
FIG. 4 is an assembly view of the leg cap assembly of FIG. 2 and the arm member of FIG. 3.
Figure 5:
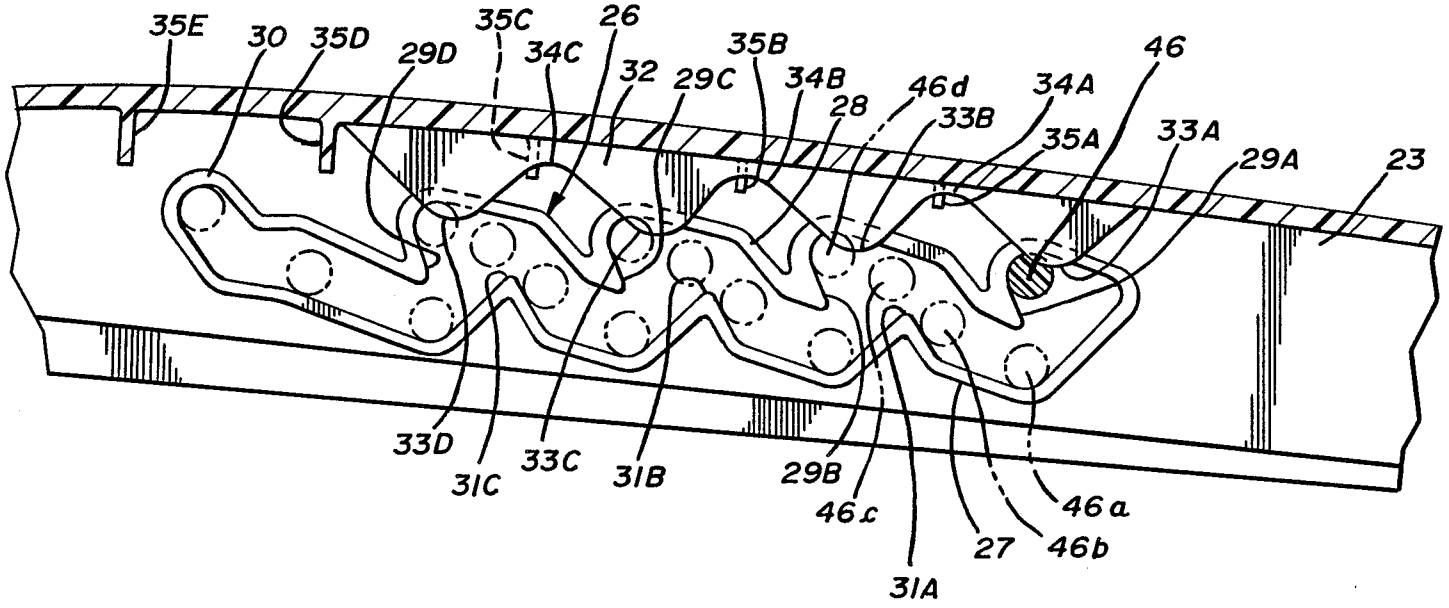
FIG. 5 is a schematic view showing the interaction between the leg cap assembly of FIG. 2 and the arm member of FIG. 3 as the relative position of the seat member and back member of the chair of FIG. 1 are being adjusted.
Figure 6:
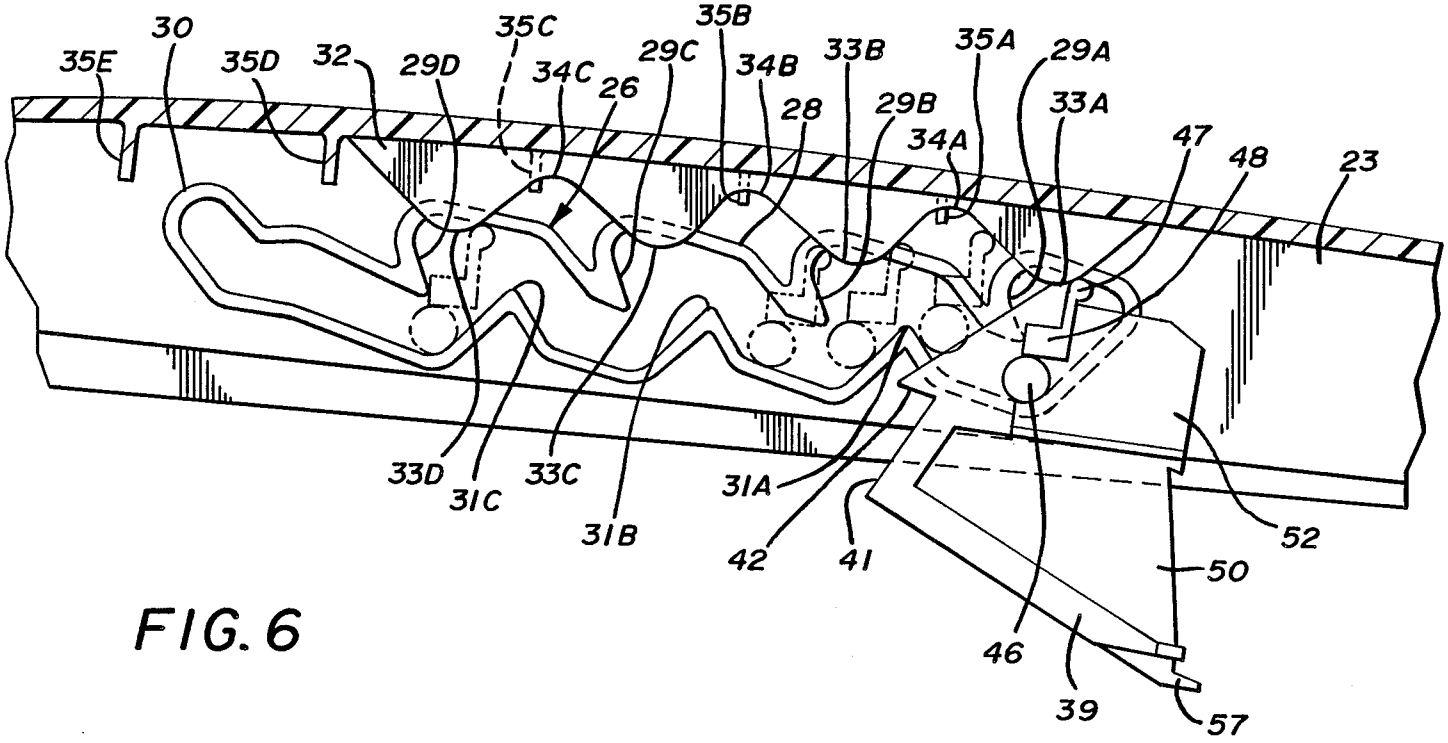
FIG. 6 is a schematic view similar to FIG. 5 but showing the interaction between the leg cap assembly of FIG. 2 and the arm member of FIG. 3 as the chair of FIG. 1 is being folded.

The internal sides of both walls 22 and 23 of each arm member 20 are provided with a track system indicated generally by the numeral 26. Track system 26 forms a closed continuous loop including a lower guide track portion 27 and an upper lock or stop track portion 28. Upper track portion 28 of track system 26 includes a plurality of longitudinally adjacent downwardly directed stop areas 29A, B, C and D with a loop 30 defining another stop area adjacent stop area 29D. Lower track portion 27 includes a plurality of longitudinally adjacent upwardly directed guide peaks 31A, B and C, with guide peak 31A being generally longitudinally medially between stop areas 29A and 29B, guide peak 31B being generally longitudinally medially between stop areas 29B and 29C, and guide peak 31C being generally longitudinally medially between stop areas 29C and 29D. For reasons to be hereinafter described, as best shown in FIGS. 4–6, the uppermost point of each guide peak 31A, B, and C is preferably somewhat higher than the lowermost point of each stop area 29A, B, C and D.

A wave-like rib 32 extends longitudinally within each arm 20 generally medially between walls 22 and 23 thereof. The peaks 33A, B, C and D of rib 32 are longitudinally positioned just inside of each stop area 29A, B, C and D of upper track portion 28 and the valleys 34A, B and C of rib 32 are longitudinally positioned just inside of guide peaks 31A, B and C of lower track portion 27. As will hereinafter be described, wave-like rib 32 is utilized during the folding of chair 10.

Each arm 20 is also provided with load bearing ribs 35A, B, C, D and E extending laterally between walls 22 and 23 thereof. Ribs 35A, B, C, D and E are positioned somewhat longitudinally outwardly of each stop area 29A, B, C and D and loop 30 and ribs 35A, B and C are slightly longitudinally inwardly of guide peaks 31A, B and C. As will hereinafter be described, ribs 35 serve as load bearing surfaces when chair 10 is adjusted in one of its several positions.

Figure 2:
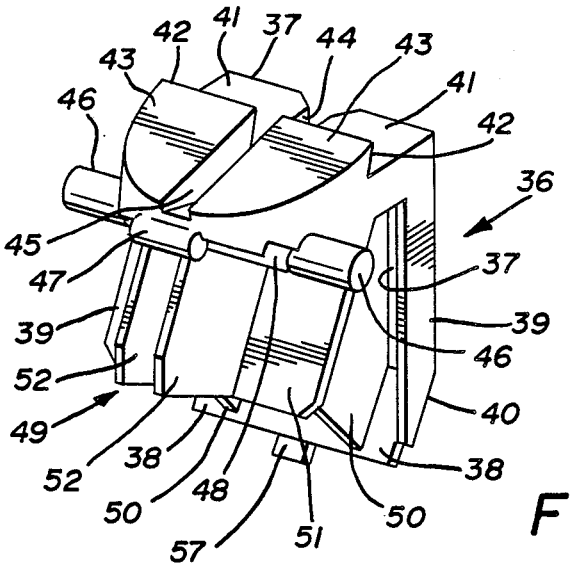
FIG. 2 is a perspective view of a leg cap assembly according to the present invention which is provided at the top of at least one of the legs of the chair of FIG. 1.

The manner in which arm members 20 interact with either front leg members 14 or rear leg members 16 will now be described in detail. Leg members 14 and 16 are preferably formed as hollow structures with either one of the sets of legs, such as rear leg members 16, being provided with a top cap, such as shown in FIG. 2 and indicated generally by the numeral 36. Each top cap 36 is designed to nest within the hollow top of each rear leg member 16 as best shown in FIG. 4.

Each top cap 36 includes a generally vertically oriented wall 37 having a sloped wall 38 extending from the bottom thereof. Wall 37, while being orientated in FIG. 2 toward the rear, is in actual position in chair 10, facing the front thereof being nested in leg 16 with wall 37 facing front leg 14 as generally shown in FIG. 4. Side walls 39 are positioned on each side of wall 37 and its sloped wall 38 with the bottom of each side wall 39 being sloped, as at 40, corresponding to the slope of wall 38. A planar top surface 41 extends laterally from the top of wall 37 and terminates at a vertically upwardly extending load bearing surface 42. A sloping top wall 43 extends away from load bearing surface 42. Both top surface 41 and sloping top wall 43 are slotted, as at 44 and 45, respectively, which, as will hereinafter be described, provides clearance for wave-like rib 32 during adjustment of chair 10.

Positioned beneath sloping top wall 43 are pin members 46 which, when assembled with arms 20, are positioned within enclosed track system 26. A follower lug 47 and an attendant support rib 48 are orientated behind pins 46 and generally beneath sloping top wall 43, with follower lug 47 being generally centrally of top cap 36 and directly beneath slot 45.

A reinforcing rib network generally indicated by the numeral 49 can be provided between back wall 37, sloped wall 38, top surface 41 and sloping top wall 43.

While rib network 49 could take on any of a variety of configurations to serve the function of reinforcing top cap 36, it is shown as including front lateral ribs 50 extending transversely from wall 37 and sloped wall 38 to an intermediate rib 51 positioned transverse to front lateral ribs 50. Rear lateral ribs 52 extend downwardly from sloping top wall 43 and transversely from intermediate rib 51. Rear lateral ribs 52 are generally positioned beneath follower lug 47.

Top cap 36 is shown in FIG. 4 in position within the top of rear leg 16 and with arm member 20 being positioned thereon. FIG. 4 shows chair 10 in the open position shown in FIG. 1 and thus leg members 14, 16, top cap 36, and arm member 20 are shown in their usual operating position. In particular, chair 10 is shown in its open position with back member 11 in its most erect position, that is, at the smallest relative angular orientation with respect to seat member 13.

Rear leg member 16 extends upwardly on its side toward the chair back member 11 to a point 53, just below follower lug 47 of top cap 36. The hollow top surface of leg 16 then slopes downwardly and abruptly upwardly to form a hook slot 54 on which pins 46 of top cap 36 rest. The sides of leg 16 then move upwardly to a top surface 55 generally coincident with top planar surface 41 of top cap 36. The side of leg 16 facing leg 14 extends only up to point 56 where a lock tab 57 of top cap 36 engages leg 16 thereby fixedly attaching top cap 36 thereto.

With top cap 36 thus positioned within the top of rear leg 16, side walls 39 and the edges of intermediate rib 51 engage the walls of leg 16 with back wall 37 of top cap 36 defining the edge of leg 16 facing leg 14. Only sloping top wall 43 with the load bearing surface 42 extend above the top of leg 16 and only pins 46 resting in slot 54 extend laterally outward of leg 16 and into track system 26 of arm member 20. Finally, only follower lug 47 extends slightly outwardly rearwardly of leg member 16. While a leg member 16 with a hollow top and insertable top cap 36 of a specific configuration have been shown herein, it should be appreciated that a solid leg member could be molded such that items such as pins 46, load bearing surface 42 and follower lug 47 would protrude therefrom without departing from the spirit of this invention.

Operation of the movement of the chair to effect a plurality of angular positions between back member 11 and seat member 13 will now be described. As shown in FIG. 4, pin 46 is in stop area 29A of upper track portion 28 with load bearing surface 42 engaging rib 35A. In such a position, the first lock position, back member 11 of chair 10 is in its most erect position at the smallest relative angular position between it and seat member 13.

The relative movement of arm member 20 and leg member 16 through its multiple operating positions is best shown schematically in FIG. 5. There, pin 46 is shown in solid lines in the first lock position 29A as is also shown in FIG. 4. If the user of the chair would now wish to recline the back 11 thereof, he need merely grasp the grip wall 24 of arm 20 with his fingers safely shielded between wall 24 and safety tab 25 and lift arm 20 generally upwardly and somewhat forwardly. This causes relative movement between track system 26 and pins 46 such that the pins 46 will now be in contact with the lower track portion 27 as indicated as **46*a* in FIG. 5. At this point the user pulls back on arm 20 or applies force on back member 11 and the relative movement of pins 46 and track system 26 moves arm 20 downward somewhat as pins 46 reach guide peak 31A of lower track portion 27, the pin position being shown as 46*b*. Continued pulling back on arm 20 or force on back member 11 causes relative movement of pins 46 and track system 26 such that the pins are generally thrown up to lock position 29B of upper track portion 28 being located at successive positions 46*c* and 46*d* shown in FIG. 5. If the user wishes further chair adjustment, the process is merely repeated with pin 46 being selectively and sequentially located, as shown in phantom in FIG. 5, at lock position 29C, 29D and finally into loop 30, the position at which back member 11 of chair 10 is most reclined and at the greatest relative angular position with respect to seat member 13. It should be noted that during this entire movement, wave-like rib 32 of arm 20 has not been engaged since it is moving through slots 44 and 45 of top cap 36**.

It should thus be appreciated that the user of chair 10 can readily select any of the multiple positions at which to recline. However, the movement is restricted and a "crash" of the chair from, for example, stop position 29A all the way to loop 30, is avoided because the guide peaks 31 of lower track portion 27 force the track system 26 to move relative to pins 46 to force the pins to be thrown upward into the next adjacent stop position. Since the uppermost point of each guide peak 31 is higher than the lowermost point of each stop area 29, the possibility of the undesirable "crash" is further avoided.

When it is desired to fold chair 10, the folding movement of seat member 13 toward back member 11 causes seat member to pivot at 15 with respect to front leg member 14 and slide along track 17 of rear leg member 16. As such, the front and rear leg members move with respect to each other on hinge 18 causing rear leg member 16 and its top cap 36 to be oriented at a different angle with respect to arm member 20, as shown in FIG. 6. Such tilting of top cap 36 from the position shown in FIG. 4 to the position shown in FIG. 6 causes follower lug 47 to engage and ride along wave-like rib 32. As such, as shown in FIG. 6, the relative positioning of track system 26 with respect to pins 46 is that pins 46 are in contact with lower track portion 27. Continued folding causes relative movement of follower lug 47 along wave-like rib 32 but rather than pins 46 being thrown up into a stop position 29, the configuration of wave-like rib 32 keeps pins 46 in contact with the lower track portion 27 throughout, as shown in phantom in FIG. 6, for a smoother, rather than intermittent, folding of chair 10.

It should thus be appreciated that the adjustable chair constructed according to the concept of the present invention represents a substantial improvement in the art and otherwise accomplishes the objects of the present invention. While the preferred embodiment of the present invention has been described herein, the teachings herein are not intended to be so restricted. For example, while a track system 26 in arm member 20 has been described as movable over stationary pins 46 associated with rear leg member 16, it should be understood that a pin associated with arm 20 could be movable with respect to a track system associated with leg member 16 without departing from the spirit of the invention. Other modifications which might utilize the teachings of the present invention are also intended to be within the scope of the present invention.

I claim:

1. In an article of furniture, a seat member, a back member pivotally attached to said seat member, leg members attached to said seat member, arm members attached to said back member, and means to position said back member at a plurality of angular positions with respect to said seat member, said means comprising a continuous loop extending longitudinally along at least one of said arm members and including an upper stop track defining a plurality of adjacent stop positions at which said seat member and said back member are at said plurality of angular positions relative to each other, said continuous loop also including a lower guide track having a plurality of upwardly extending guide peaks, each said stop position being defined by a portion of said upper track extending downwardly toward said lower guide track, the uppermost point of each said guide peak being higher than the lowermost point of each said portion of said upper track, and pin means carried by at least one of said leg members and being position within said continuous loop so as to be engageable with one of said plurality of adjacent stop positions such that upon relative movement of said continuous loop and said pin means by movement of said back member away from said seat member the next of said adjacent stop positions is engaged by said pin means, said back member and said seat member thereby being prevented from moving to other than the next adjacent relative angular position.

2. In an article of furniture according to claim 1, wherein each said guide peak of said lower guide track is longitudinally positioned generally medially of each said stop position of said upper track.

3. In an article of furniture according to claim 2, said guide peaks of said lower guide track engaging said pin means as said arm member is moved relative thereto to assure that only the next of said stop positions of said upper track engages said pin means.

4. In an article of furniture according to claim 2, said arm member including a plurality of laterally extending load bearing ribs, said load bearing ribs being longitudinally positioned between each said stop position of said upper track and each said guide peak of said lower track, said leg member including means to engage a said load bearing rib when a said stop position is engaged by said pin means.

5. In an article of furniture according to claim 2, said arm member including a wave-like rib extending longitudinally thereof and having peaks and valleys, said peaks being longitudinally adjacent to each said stop position of said upper track and said valleys being longitudinally adjacent to each said guide peak of said lower track.

6. In an article of furniture according to claim 5, said leg members including front leg members and rear leg members, each said front leg member being hinged to each said rear leg member for pivotal movement upon folding of the article of furniture.

7. In an article of furniture according to claim 6, lug follower means on one of said leg members, said lug follower means being operatively positioned on said wave-like rib when said front and rear leg members are moved relative to each other during folding so that said pin means engages said lower guide track during folding of the article of furniture.

8. In an article of furniture according to claim 1, means on at least one of said arm members to prevent the user of the article of furniture from contacting said track means and said pin means.

9. In an article of furniture according to claim 1, cap means mounted on the top of at least one of said leg members, said cap means including said pin means.

10. In an article of furniture according to claim 13, said leg member having a hook slot for receiving said pin means such that said pin means extend outwardly from said leg member.

11. In an article of furniture according to claim 10, wherein said track means is carried by at least one of said arm members, said arm member including a plurality of load bearing ribs.

12. In an article of furniture according to claim 11, said cap means further including load bearing means extending above said leg member to engage a said load bearing rib when a said stop position is engaged by said pin means.

13. In an article of furniture according to claim 12, said arm member including a wave-like rib, said cap means having a slot in the upper surface thereof receiving said wave-like rib.

14. In an article of furniture according to claim 13, said leg members including front leg members and rear leg members, each said front leg member being hinged to each said rear leg member for pivotal movement upon folding of the article of furniture, said cap means having a lug follower means extending outwardly of said leg member to which it is mounted, said lug follower means being operatively positioned on said, wave-like rib when said front and rear leg members move relative to each other.

15. An article of furniture comprising a seat member, a back member pivotally attached to said seat member, front and rear leg members attached to said seat member and pivotally attached to each other, arm members attached to said back member, interacting means on at least one of said arm members including an upper stop track defining a plurality of stop positions at which to locate said back member at a plurality of angular positions with respect to said seat member and a lower guide track, said interacting means also including pin means on at least one of said leg members being positioned between said upper stop track and said lower guide track, and means to avoid the action of said interacting means when said seat member is being folded against said back member including a wave-like rib on said one of said arm members, and lug follower means on said one of said members.

16. An article of furniture according to claim 15 wherein said lower guide track includes means to assure that said pin means will engage one of said plurality of stop positions unless prohibited from doing so by said means to avoid the action of said interacting means, said means to assure including a plurality of guide peaks defined by said lower guide track, each said guide peak extending upwardly toward said upward stop track, the uppermost point of each said guide peak being higher than the lowermost point of each said stop position of said upper track.

17. An article of furniture according to claim 16 wherein said means to avoid the action of said interacting means includes means to force engagement of said pin means with said lower guide track.

18. An article of furniture according to claim 17 wherein said means to force engagement includes rib means on one of said arm members and follower means on one of said leg members.

19. An article of furniture according to claim 15 wherein said interacting means includes means to assure that said back member and said seat member will be moved only to the next adjacent of said plurality of stop positions.

20. An article of furniture according to claim 19 wherein said means to assure includes pin means and track means relatively movable with respect to said pin means and having an upper track including a plurality of stop positions and a lower track including a plurality of guide peaks.

21. An article of furniture according to claim 20 wherein said pin means first engages a said guide peak upon relative movement with said track means and then engages the next adjacent stop position.

22. An article of furniture according to claim 21 wherein said means to avoid the action of said interacting means maintains said pin means in engagement with said guide peaks.

23. In an article of furniture according to claim 8, said arm members including an end wall, a first sidewall extending from said end wall, a second sidewall opposite said first sidewall, a grip wall flaring outwardly from said second sidewall and connected to said end wall, said grip wall to be engaged by the user of the article of furniture to position said seat member and said back member at said plurality of angular positions, said means to prevent being disposed between said first sidewall and said grip wall.

24. An arm according to claim 23 wherein said means includes a tab wall extending from said second sidewall toward said end wall.

25. An arm according to claim 24 wherein said tab wall is positioned adjacent to the point at which said grip wall flares outwardly from said second sidewall.

* * * * *

UNITED STATES PATENT AND TRADEMARK OFFICE

CERTIFICATE OF CORRECTION

PATENT NO. : 4,784,432

DATED : November 15, 1988

INVENTOR(S) : Jerrold G. Brown

It is certified that error appears in the above-identified patent and that said Letters Patent is hereby corrected as shown below:

Column 8, line 4, claim 10, "13" should read --9--.

Column 8, line 47, claim 15, after "said" (second occurrence) insert --leg--.

Signed and Sealed this

Twenty-second Day of August, 1989

*Attest:*

DONALD J. QUIGG

*Attesting Officer*

*Commissioner of Patents and Trademarks*